US007383607B2

(12) United States Patent
Johnson

(10) Patent No.: US 7,383,607 B2
(45) Date of Patent: Jun. 10, 2008

(54) AGITATION APPARATUS

(75) Inventor: Mark Andrew Johnson, Bath (GB)

(73) Assignee: Dyson Technology Limited, Wiltshire (GB)

( * ) Notice: Subject to any disclaimer, the term of this patent is extended or adjusted under 35 U.S.C. 154(b) by 567 days.

(21) Appl. No.: 10/529,250

(22) PCT Filed: Sep. 9, 2003

(86) PCT No.: PCT/GB03/03892

§ 371 (c)(1),
(2), (4) Date: Mar. 25, 2005

(87) PCT Pub. No.: WO2004/028328

PCT Pub. Date: Apr. 8, 2004

(65) Prior Publication Data

US 2005/0251952 A1 Nov. 17, 2005

(30) Foreign Application Priority Data

Sep. 28, 2002 (GB) ..... 0222565.4

(51) Int. Cl.

| | |
|---|---|
| ***A47L 5/14*** | (2006.01) |
| ***A47L 5/00*** | (2006.01) |
| ***A47L 9/04*** | (2006.01) |
| ***A47L 9/06*** | (2006.01) |

(52) U.S. Cl. ..... 15/345; 15/346; 15/377; 15/404

(58) Field of Classification Search ..... 15/345, 15/346, 377, 404; 381/349–351
See application file for complete search history.

(56) References Cited

U.S. PATENT DOCUMENTS

| | | | | |
|---|---|---|---|---|
| 2,932,054 | A * | 4/1960 | Lichtgarn | 15/363 |
| 5,400,466 | A * | 3/1995 | Alderman et al. | 15/363 |
| 2001/0027087 | A1 | 10/2001 | Shiomi et al. | |

FOREIGN PATENT DOCUMENTS

| | | |
|---|---|---|
| JP | 58-13180 A | 1/1983 |
| JP | 61-230779 | 10/1986 |

(Continued)

OTHER PUBLICATIONS

Notice of Reasons for Rejection, mailed on Jan. 15, 2008, directed to corresponding Japanese Patent Application No. 2004-539170. 10 pages.

*Primary Examiner*—Joseph J. Hail, III
*Assistant Examiner*—Bryan R Muller
(74) *Attorney, Agent, or Firm*—Morrison & Foerster LLP

(57) ABSTRACT

An agitation apparatus which is suitable for use in a cleaning head of a vacuum cleaner includes first and second flow paths. Each of these flow paths has a resonant cavity and an inlet/outlet port which joins the cavity to a space within the cleaning head. A generator, such as a loudspeaker with a diaphragm, generates an alternating pressure wave between the ports. Pressure waves are emitted from one of the ports in an anti-phase relationship with the pressure waves from the other of the ports, thus reducing operating noise. Due to both sides of the generator or diaphragm being exposed to an equal static pressure, the generator operates more reliably. A plurality of these arrangements can be provided across the cleaning head, and a part of the agitation apparatus, such as the driver, can be mounted on the main body of the vacuum cleaner.

26 Claims, 10 Drawing Sheets

FOREIGN PATENT DOCUMENTS

| | | | | |
|---|---|---|---|---|
| JP | 61-178088 | U | | 11/1986 |
| JP | 08-336490 | A | | 12/1996 |
| JP | 09-23998 | A | | 1/1997 |
| JP | 9-140641 | | | 6/1997 |
| JP | 09140641 | A | * | 6/1997 |
| JP | 2000-45953 | A | | 2/2000 |
| JP | 2000-130345 | | | 5/2000 |
| JP | 2002-223995 | | | 8/2002 |

* cited by examiner

AGITATION APPARATUS

FIELD OF THE INVENTION

This invention relates to an agitation apparatus which is particularly suitable for, but not limited to, use with a cleaning appliance such as a vacuum cleaner.

BACKGROUND OF THE INVENTION

Vacuum cleaners generally remove dirt, dust and other debris from a surface by a combination of a suction force, generated by a motor-driven fan, and some form of mechanical agitation of the floor surface. The mechanical agitation often takes the form of a rotating brush bar which is driven by a motor or by an air turbine. The rotating brush bar 'beats' the carpet pile while the suction force 'sucks' dirt and dust from the surface.

Agitation of a carpet by a brush bar inevitably causes some damage to the carpet and also causes wear on the brush bar and the drive system for the brush bar.

There have been various proposals for tools which make use of a vibrating airstream to promote the release of dirt from a carpet. U.S. Pat. No. 5,400,466 shows a cleaning head with a loudspeaker supported and sealed within the cleaning head which directs airwaves towards the surface in the frequency range of 10-200 Hz or 200-500 Hz.

However, tools of this kind have a disadvantage in that they can be noisy in use. Also, the use of a loudspeaker near to a source of suction causes problems with operation of the loudspeaker since there is a tendency for the loudspeaker cone to be sucked towards the source of suction.

SUMMARY OF THE INVENTION

The present invention seeks to provide an improved way of agitating a surface or other medium which requires agitation.

Accordingly, a first aspect of the present invention provides an agitation apparatus that includes a generating means or a generator for generating alternating pressure waves and a first fluid flow path with an inlet/outlet port and a second fluid flow path with an inlet/outlet port. The area adjacent the inlet/outlet ports forms an agitation region, and wherein the generator is arranged to generate a first alternating pressure wave along the first fluid flow path and a second alternating pressure wave along the second fluid flow path so that the first and second pressure waves being substantially in an anti-phase relationship with one another.

This agitation system has an advantage in that pressure waves are emitted from a first of the ports in anti-phase with the pressure waves from the second of the ports. At a normal operating distance from the apparatus (the so-called far-field), a user will hear little or no noise from the apparatus since the pressure waves cancel one another. Although there is little or no noise, there is still a net flow of air between the ports which can agitate something placed beneath the ports. The generating means functions as a kind of air pump, acting on the volume of air in the flow paths.

The agitation apparatus is particularly suitable for use with, or as part of, a cleaning appliance such as a vacuum cleaner. Accordingly, further aspects of the invention provide a cleaning head, a vacuum cleaner and an agitation apparatus for use with a vacuum cleaner. The ports of the agitation apparatus can form part of a cleaning head of the cleaning appliance. The agitation apparatus is particularly suitable for use as part of a suction head of a vacuum cleaner since any material which is dislodged by the pressure waves can be carried away by the main suction flow through the suction head. A further advantage when this arrangement is used as part of a vacuum cleaner is that, since the two sides of the generating means (diaphragm) are exposed to an equal static pressure, the diaphragm will not be sucked towards the source of suction on the cleaner. However, it will be appreciated that the applications of this apparatus extend beyond cleaning appliances.

The absence of mechanical contact with the surface can help to reduce wear on the surface. Rather than mechanically agitating the carpet, the air motion vibrates the pile of the carpet, drawing out dust from the carpet pile. This dust can be extracted along with the bulk air flow. Preferably, the frequency of the generating means is equal to, or close to, the resonant frequency of the carpet pile. This can help to 'boil' dirt upwards from the base of the carpet pile towards the surface. Preferably the frequency of operation of the generating means is manually adjustable, or automatically adjustable according to the type of carpet or surface beneath the cleaning head.

In its simplest form, each flow path is a cavity with a port extending directly from it. The generating means can act directly on the cavity. In a more elaborate scheme, the flow path can comprise further ducting which connects the main, resonating, cavity to the generating means. This scheme can be of use in applications where it is undesirable, or impossible, to house the generating means adjacent to where the agitation is required. As an example, in a vacuum cleaner it is undesirable to increase the size and weight of the cleaner head. Thus, the generating means can be positioned on the main body of the vacuum cleaner with ducting connecting the generating means to the resonating cavity on the cleaner head.

Each cavity can have a single port or a plurality of ports. The shape of the ports can be adapted to the application. A rectangular cross-section has been found to work well when the agitation apparatus forms part of a cleaning head.

Preferably the generating means comprises a diaphragm. The term 'diaphragm' is intended to be construed broadly, to encompass a broad range of movable members. The diaphragm can be either a flexible member or a rigid member which is flexibly mounted to the walls of the compartment. Where a single diaphragm is used, a first side of the diaphragm communicates with the first flow path and a second side of the diaphragm communicates with the second flow path so that the two sides of the diaphragm generate the first and second alternating pressure waves. A driver for driving the diaphragm can be housed within one of the flow paths (or cavities), or there can be two drivers, one on each side of the diaphragm.

Where two diaphragms are used, these can be spaced apart from one another with a driver mounted between them. Preferably the diaphragms are driven in unison so that one flow path (or cavity) is compressed as another is rarefied.

Preferably the first and second cavities are of substantially the same volume. The more symmetrical the system is made, the better matched the two pressure waves will be, and thus the better the two pressure waves will cancel one another. Preferably the cavities are tuned for the frequency at which the generating means operates, as this maximises the quality factor (Q) of the apparatus. We have also found that it is preferable for the ports to be tuned at a frequency which is greater than (such as twice) the frequency of operation of the generating means as this maximises air movement through the ports.

The generating means can be in the form of a loudspeaker. It is possible for the coil, or the magnet, to be mounted to, and movable with, the diaphragm while the other of the magnet or coil remains stationary. A loudspeaker type of driver has an advantage in that it is cheaper and produces lower noise in operation compared to a piston type of driver, since there is no direct connection to the diaphragm. Other forms of the generating means include a cam or a piston which acts on the diaphragm or diaphragms, the cam or piston being driven by a motor or by airflow through the appliance. The coil of the loudspeaker can be directly driven by a signal at mains frequency or from a signal derived from a signal source.

For an agitation apparatus which is part of a cleaning head for use with floor surfaces, it has been found that best results are obtained with the generating means generating a pressure wave with a frequency in the range 0-200 Hz.

Preferably the ports are arranged so that they are directed downwardly towards a surface and inclined towards one another.

A cleaning head can incorporate a plurality of the agitation apparatus.

BRIEF DESCRIPTION OF THE DRAWINGS

Embodiments of the invention will now be described with reference to the drawings, in which.

DETAILED DESCRIPTION OF THE INVENTION

Figure 1A:
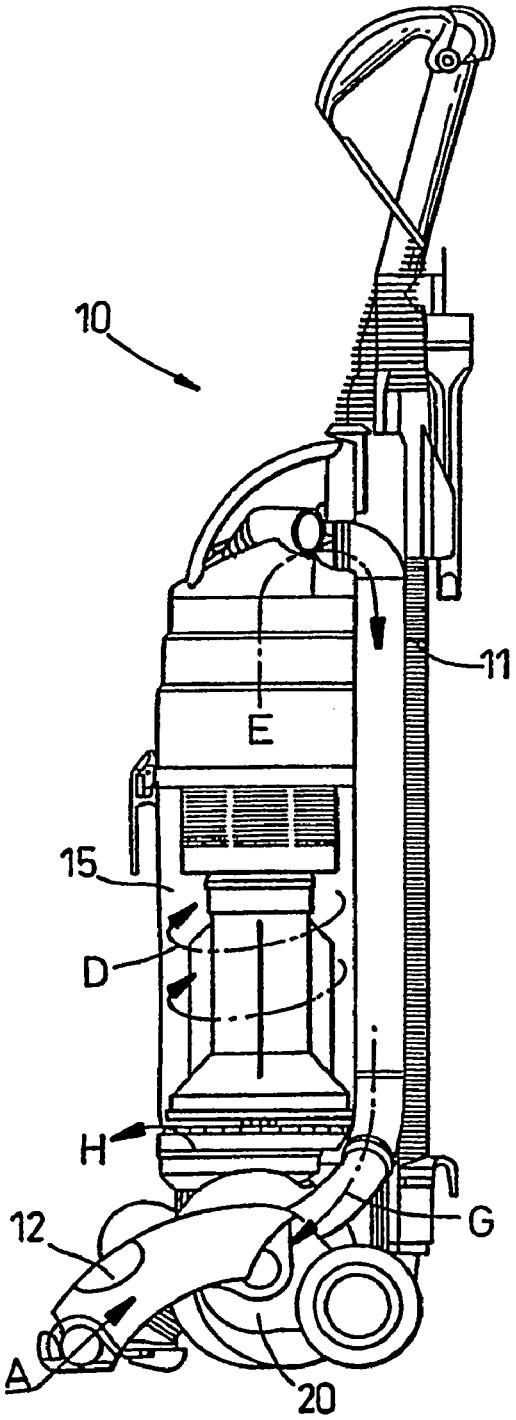
FIGS. 1A and 1B show a conventional upright type of vacuum cleaner in which the agitation apparatus can be used.
Figure 1B:
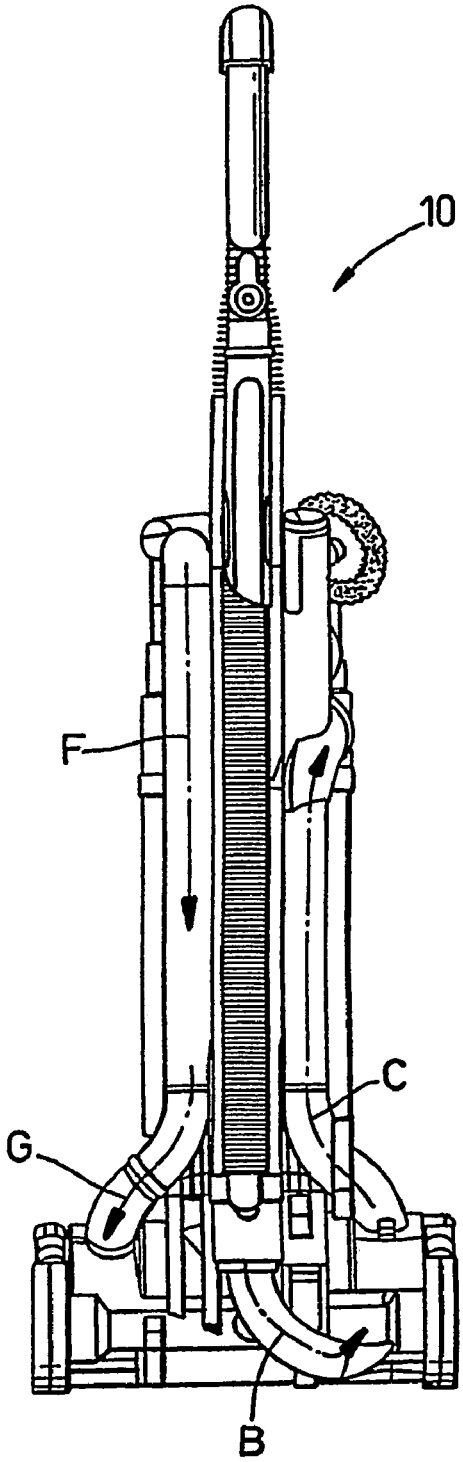

Before describing the cleaning head in detail, FIGS. 1A and 1B show an example of an upright type of vacuum cleaner in which the cleaning head can be used. Dirty air can be drawn into the cleaner via a cleaner head 12, if on-the-floor cleaning is required, or via a hose and wand assembly 11, if above-the-floor or manual cleaning is required. Dirty air is drawn into the cleaner along path A. The dirty air is carried along path C before entering a separating apparatus 15 which serves to separate dirt and dust from the dirty air (path D) as well as collect the separated material. The separating apparatus can be a cyclonic separator, as shown here, or some other form of separator, such as a filter bag. Cleaned air leaves the separator along paths E, F before entering (G) a fan and motor housing 20 at the base of the cleaner. The fan and motor housing 20 supports a fan and a motor to drive the fan. In use, the motor 25 rotates the fan to draw air along the paths A-H through the cleaner. Air is exhausted from the cleaner (path H) via a suitable outlet.

Figure 2:
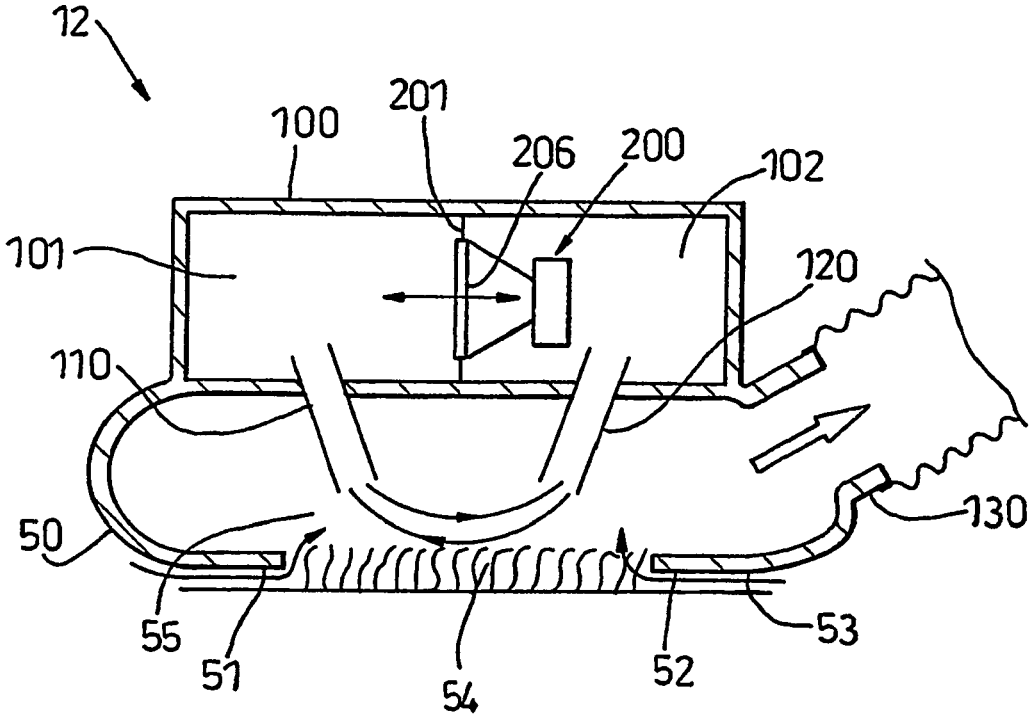
FIG. 2 shows a cleaning head incorporating the agitation apparatus.

A cleaning head 12 for use in this vacuum cleaner is shown in cross-section in FIG. 2. The casing 50 of the cleaning head 12 defines a suction housing. The lower, floor facing side 53 of the suction housing is a sole plate which can ride along the floor surface. Small rollers may also be provided on the base of the sole plate to allow the cleaning head to roll across hard floor surfaces. A suction opening 54 is defined in the sole plate 53. In use, the floor covering (such as a carpet) projects through the suction opening 54. A suction outlet 130 connects the suction housing 50 to the separating apparatus and fan and motor on the main body of the vacuum cleaner, as previously described. These features are all well known in conventional cleaning heads.

Mounted on the upper face of the cleaning head 12 is the agitation system. In its simplest form, this comprises a housing 100 which is divided into two compartments, or cavities, 101, 102. For each cavity 101, 102, a tube-like port 110, 120 extends from the inside of the cavity 101, 102 into the suction housing 55. The two cavities 101, 102 are separated by a dividing wall 201. A diaphragm 206 of a driver 200 is mounted in an aperture in the dividing wall 201 and sealed against the wall 201, as better shown in FIG. 3. In this embodiment the driver 200 is schematically shown in the form of a loudspeaker. Each side of the diaphragm 206 communicates with a respective one of the cavities, 101, 102 i.e. a first side of the diaphragm 206 communicates with cavity 101 and a second side of the diaphragm 206 communicates with cavity 102. The outer edge of the diaphragm 206 is connected to the dividing wall 201 by a flexible seal 204 which allows the diaphragm 206 to move, in use, but maintains an airtight seal between the cavities 101, 102. This seal 204 extends around the entire perimeter of the diaphragm 206. The diaphragm 206 is driven by a magnet 210 and coil 215 combination which in turn is driven by an ac source. This will be described in more detail below. The ac frequencies can be in the range of 0 to 200 Hz. The driver 200 serves to move air backwards and forwards between the ports 110, 120 and across the carpet pile, or other floor covering, which projects into the suction inlet 54 of the cleaning head.

Each cavity 101, 102 has a volume V which is driven by the diaphragm 206 at the chosen frequency. The driver 200 compresses the air in the cavity, the compressed air venting through the port 110. When the driver changes direction, the air motion also changes direction. The phase relationship between movement of the diaphragm 206 and movement of air through the ports 110, 120 varies according to the frequency of operation. At low frequencies, the movement of the diaphragm 206 is generally in phase with movement of air from the port, e.g. as the diaphragm 206 moves towards the left, in FIG. 2, air is pumped from cavity 101 and out of port 110 into the suction housing 55, towards the carpet. At the same time, air is drawn from the suction housing 55, along port 120 and into cavity 102. When the diaphragm 206 moves towards the right, air moves in the opposite direction, i.e. air is pumped from cavity 102 and out of port 120, into the suction housing 55, towards the carpet while, at the same time, air is drawn from the suction housing 55, along port 110 and into cavity 101. At higher frequencies the phase relationship between movement of the diaphragm 206 and movement of air through the port is different and typically there is a phase lag between movement of the diaphragm 206 and movement of air through the port. However, at all frequencies of operation, the wave from port 110 is in anti-phase with the wave from port 120.

It will be appreciated that there is no contact between the agitation system and the carpet, which should have a significant benefit in reducing carpet wear. The air motion to/from the ports 110, 120 vibrates the pile of the carpet and serves to draw out dust from between the carpet fibres. Any dislodged dust can then be extracted with the bulk air flow, which flows into the space 55 within the suction housing, under edges 51, 52 of the sole plate or through bleed inlets on the ends of the suction housing 50.

Figure 4:
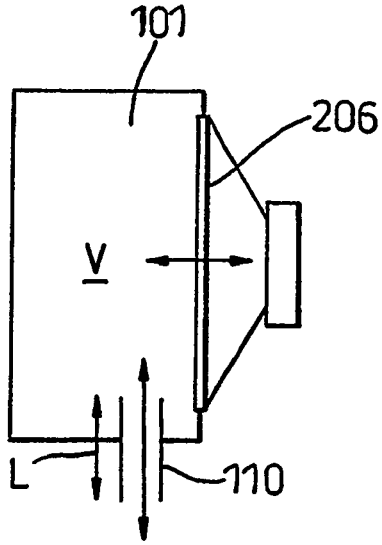
FIG. 4 shows a single one of the cavities used in the agitation apparatus.

FIG. 4 shows a single one of the cavities. The volume V of the cavity 101, the cross-sectional area A of the port 110 and the length L of the port 110 determine the frequency at which this cavity/port is tuned. The equations for this are based around the Helmholtz equation:

$$f_1 = \frac{c}{2\pi}\left\{\frac{\pi a^2}{V\left(L+\frac{\pi a}{2}\right)}\right\}^{\frac{1}{2}}$$

where:

c=speed of sound a=port radius

L=port length

V=cavity volume

For this application we need to use the system at a point where the ports 110, 120 are not tuned. Tuning the ports to a frequency that is twice that of the desired operational frequency allows a large amount of air movement through the port. Ideally the driver box resonance should still be the frequency of desired operation to maximise the Q (quality factor) of the system. There is a phase change on any ported system where, at very low, or near zero, frequencies, the air in the port moves with the piston. At port resonance, the port and driver are 180 degrees out of phase, both compressing and rarifying the air in the cavity simultaneously minimising air and diaphragm excursion. At half this frequency (the desired operational frequency) there is a compromise where the air only lags behind the driver movement by a few degrees phase. The design of the driver cavity resonance should maximise the energy in the air which is proportional to displacement (i.e. volume of air displaced) multiplied by frequency. The actual air volume used is a compromise which allows the speaker to move enough to maintain low coil temperatures but add enough loading so that it does not fail mechanically.

This arrangement of the agitation system has some advantages. Firstly, by providing two ports 110, 120, each communicating with a respective side of the diaphragm 206, the diaphragm 206 is subject to an equal static pressure drop. This minimises, or eliminates, the tendency for the diaphragm 206 to move towards the source of suction.

A second advantage which results from the use of two ports is noise cancellation. As the port moves air at a given frequency, pressure waves are created into the environment making the system act as a bandpass bass reflex loudspeaker cavity. By placing the two ports close together they operate out of phase, cancelling the pressure waves and therefore reducing the noise level of the system to a point which should be below that of the vacuum cleaner. It should be noted that the term "close" means that the distance between port centres is small compared to the wavelength of the frequency being produced. The amount of sound level reduction depends on the symmetry of the system, i.e. the volumes of the cavities and the port sizes, the distance between the ports, the absence of any obstructions near the port entry/exit, the frequency of the resulting wave. Also, any transmission of sound through the walls 100 of the cavity determines the lowest possible sound level of the system.

In this embodiment, each of the cavities 101, 102 is shown having the same shape and volume. It is possible to vary the shape of each cavity, e.g. cavity 101 could have a lower height than cavity 102, although it is important that the volumes of the cavities should be equal, and that the system Q factor is as balanced as possible.

Figure 5:
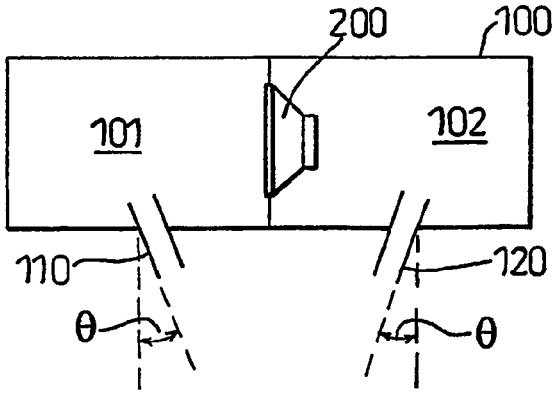
FIG. 5 shows the positioning of the ports on the agitation apparatus.

The ports 110, 120 are shown angled towards one another. Although the ports 110, 120 can be vertically directed, a direction of an angle θ from the vertical (as shown in FIG. 5) has the advantage that the air flow from the ports has both transverse and vertical components to its velocity. An angle θ of 90° will also work, although it works less well.

Figure 6:
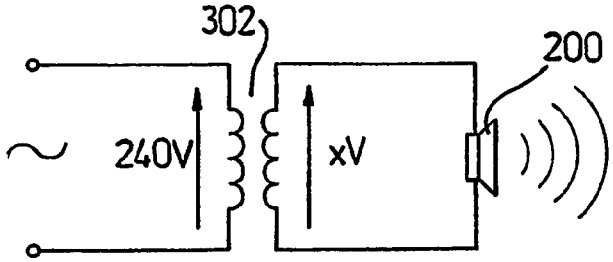
FIG. 6 shows a first way of driving the generating means.
Figure 7:
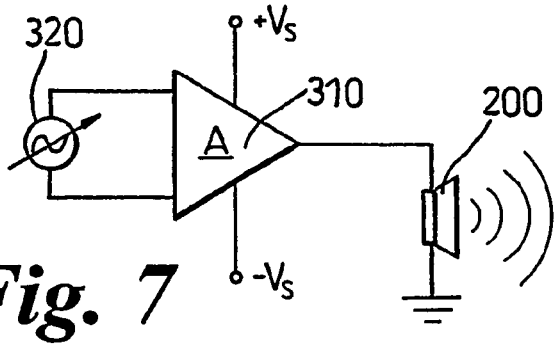
FIG. 7 shows a second way of driving the generating means.

FIGS. 6 and 7 show two ways in which the driver 200 can be driven. FIG. 6 shows a simple scheme in which the driver 200 is connected to a mains electricity supply via a transformer 302. The transformer 302 serves to step the voltage from mains voltage (240V or local equivalent) down to a lower voltage, e.g. 12-50V, which is suitable for driving the driver 200. In this scheme the driver 200 is driven at the frequency of the mains supply, i.e. 50 Hz or 60 Hz. This scheme has the advantage of requiring few components, but has the limitation that the driver 200 can only operate at the frequency of the mains supply.

FIG. 7 shows an alternative scheme where the driver 200 is driven by an amplifier 310. The amplifier 310 is powered, in a conventional manner, by a power supply ($+V_s$, $-V_s$) which is derived from the mains supply of the vacuum cleaner. An oscillator 320, or other frequency source, is connected to the inputs of the amplifier 310. The signal fed to the driver 200 is thus an amplified version of the signal generated by source 320. While this scheme requires more components, it offers the user with control over the intensity of the signal generated by driver 200, by control of the amplifier gain. A manual control can be provided on the cleaning head, or on the main body of the vacuum cleaner, to vary the intensity of the driver 200.

The optimum frequency of operation of the driver 200 has been found to vary according to the type of carpet. Factors such as the density and length of fibres forming the carpet pile and the weave of the carpet determine the frequency at which the fibres will move. Ideally, the driver 200 operates at the resonant frequency of the carpet. This requires the driver to be variable. The circuitry shown in FIG. 7 allows the frequency of operation to be varied, by varying the frequency of the signal source 320. A further manual control can be provided on the cleaning head, or on the main body of the vacuum cleaner, to vary the frequency of the source 320. The control can be marked with the frequency or, more helpfully, with labels indicative of the type of carpet which correspond to each frequency in the range. For example, a frequency of around 50 Hz could correspond to "plush carpets" and a frequency of around 115 Hz could correspond to "Wilton carpets".

Figure 8:
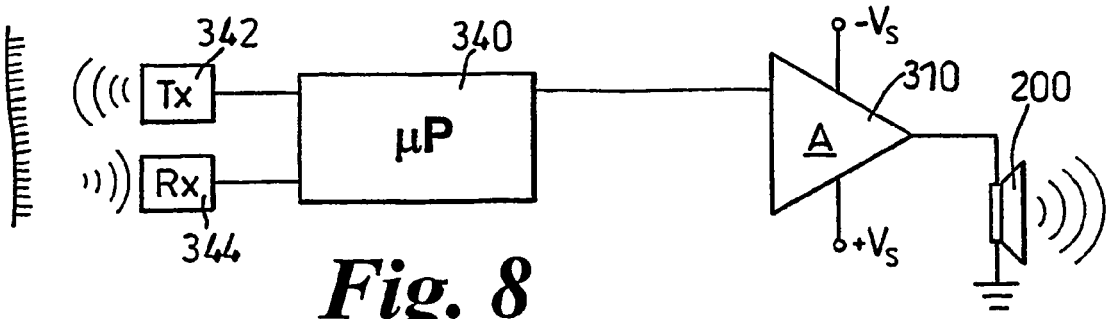
FIG. 8 shows a way of automatically adjusting the frequency of operation of the generating means.

A further refinement is shown in FIG. 8. Here, the scheme of FIG. 7 has been adapted so that the frequency of operation of driver 200 is automatically determined by a carpet type detector. For convenience, the signal which is applied to amplifier 310 is generated by a microprocessor 340. Microprocessor 340 can generate a signal using data stored in a memory associated with the microprocessor 340. The microprocessor 340 also has an ultrasonic transmitter and receiver associated with it. Under the control of microprocessor 340, transmitter 342 emits a signal, with a predetermined frequency, towards the carpet. Transmitter 344 receives a signal from the carpet and either the amplitude, phase or time delay of the received signal with respect to the transmitted signal, or a combination of these quantities, can be used to determine the type of carpet.

The analysis of the received signal is performed by the microprocessor 340 and used to determine which one of the stored signals should be applied to amplifier 310. It will be appreciated that other techniques could be used to determine the carpet type, such as the use of electromagnetic radiation of a predetermined frequency, or band of frequencies.

Figure 17:
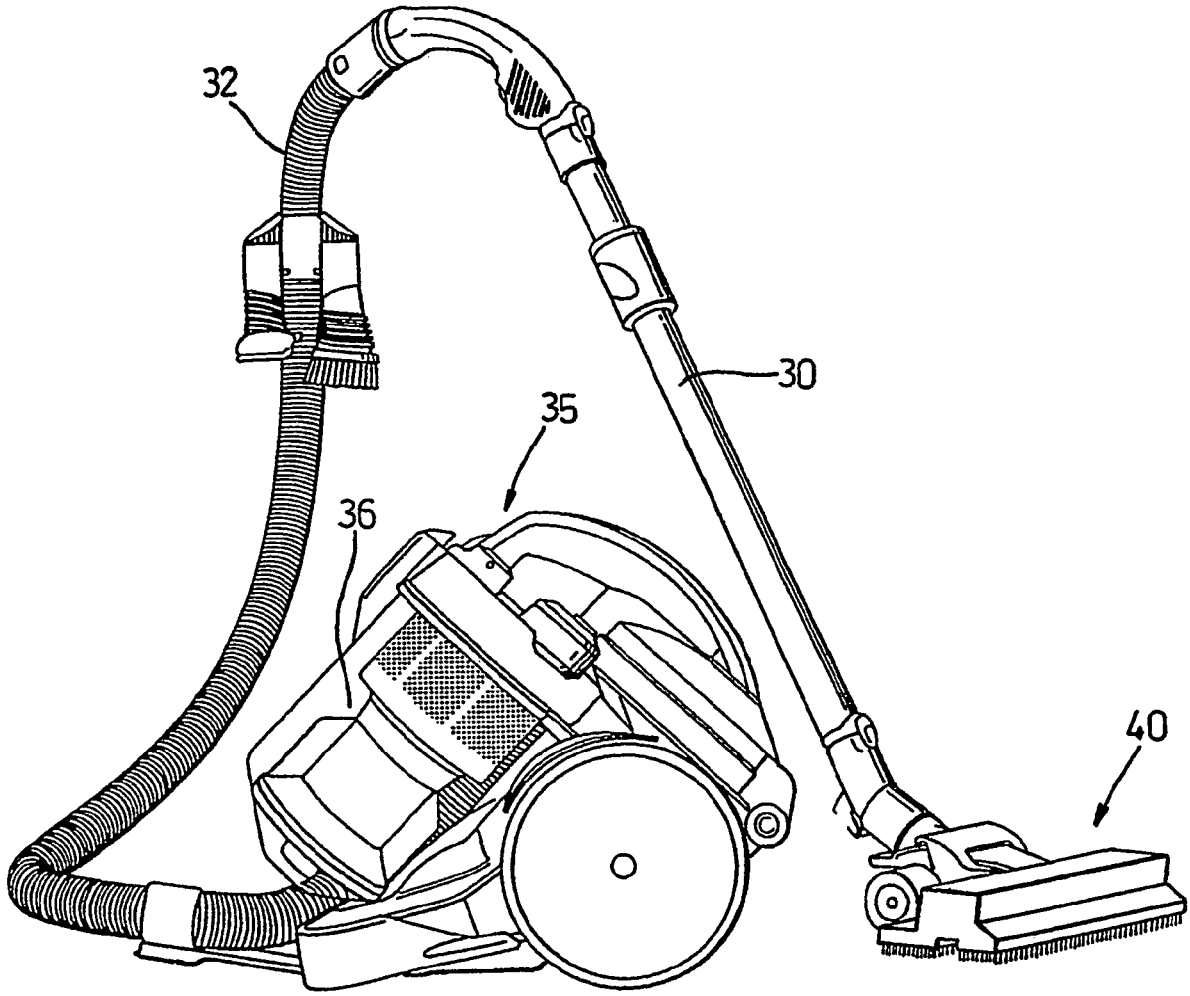
FIG. 17 shows a cleaning head for use with a cylinder type of vacuum cleaner.

For completeness, FIG. 17 shows a cylinder type of vacuum cleaner (called a canister or barrel cleaner in some countries) with a floor tool 40 incorporating the agitation apparatus.

So far, the driver 200 has been shown as a diaphragm with the driver (magnet, coil etc.) positioned in one of the cavities 101, 102. The presence of the driver in one of the cavities should not significantly affect the symmetrical nature of the system, since air can easily reach the diaphragm 206 by passing through and/or around the structure of the driver. Referring again to FIG. 3, the suspension 212 of the driver is porous and there are spaces in the chassis 208. However, it is preferable to increase the size of cavity 102 compared to cavity 101 so that the free-space, volume of cavity 102 matches that of cavity 101, i.e. the total volume of cavity 102 equals the volume of cavity 101 plus the volume occupied by driver 200.

Figure 9:
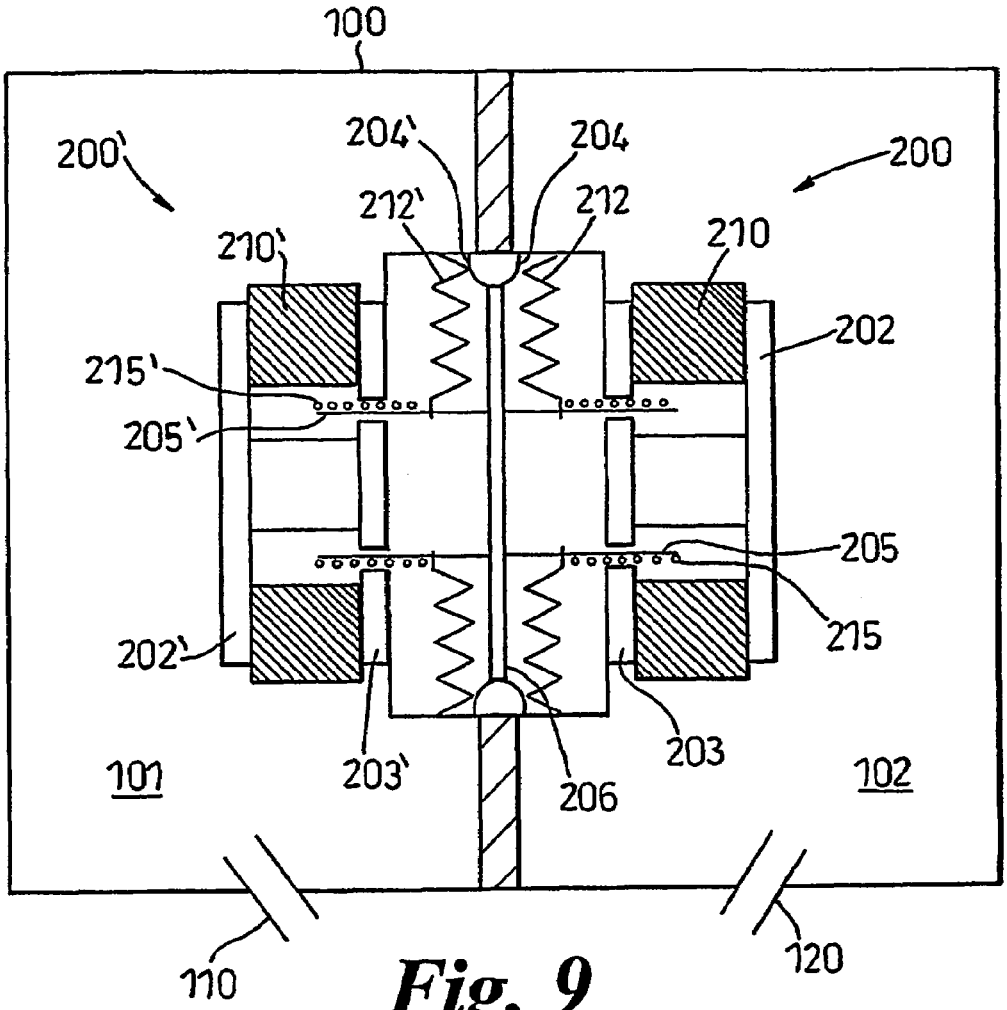
FIG. 9 shows a symmetrical driver arrangement for the agitation apparatus.

In an alternative scheme the driver itself is symmetrical. As shown in FIG. 9, this has the structure of two drivers 200, 200' mounted face on to one another, with the diaphragm 206 being common to both drivers. Connections to the coils 215 of the drivers are reversed with respect to one another so that the drivers serve to drive the diaphragm 206 in the same direction when they are energised by a common signal. To explain, driver 200 moves diaphragm 206 towards the left at the same time as driver 200' also moves diaphragm 206 towards the left. Diaphragm 206 can be a single diaphragm or it can be two diaphragms mounted face-to-face with one another.

Figure 10:
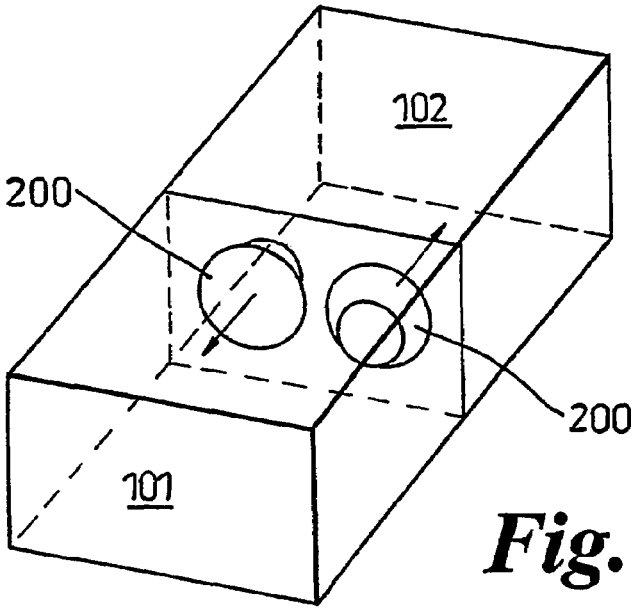
FIG. 10 shows another driver arrangement for the agitation apparatus.

In a further alternative scheme, shown in FIG. 10, each cavity has one complete driver unit 200 mounted within it, with its own diaphragm formed in the wall with the neighbouring cavity. Connections to the coils of the two drivers 200 are reversed so that the two drivers both move their respective diaphragms in the same direction.

Figure 11:
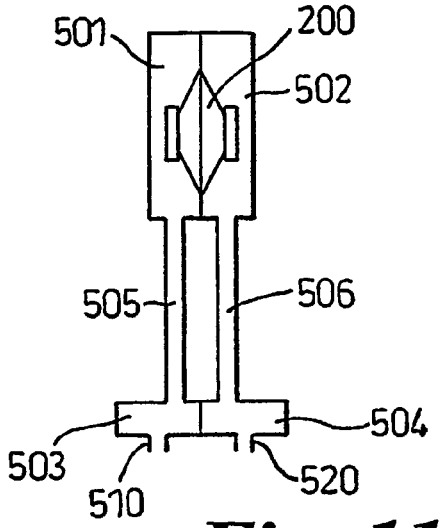
FIGS. 11 to 13 show arrangements where a part of the agitation apparatus is positioned away from the cleaning head.

The driver or drivers do not have to be positioned within the resonant cavities 101, 102, nor do they need to be positioned directly above the cleaning head. In the embodiment shown in FIGS. 11-13 the driver (or drivers) 200 are mounted within small cavities 501, 502 positioned remotely from the resonating cavities 503, 504 and a pair of connecting pipes 505, 506 join the cavities 501, 502 to resonating cavities 503, 504. By using a small driver cavity and maximising the pressure available at the connecting tubes, a second cavity can be used for the port/cavity resonance. The remote mounting of the driver has the advantages of reducing the size of the cleaner head and allows a greater choice of driver, since there is less restriction on dimensions etc.

The remote positioning of the driver 200 can have a penalty in a slight loss of performance, since there are losses which result from transmitting pressure waves down the connecting pipes 505, 506. As a rule, these losses tend to increase as the connecting pipes 505, 506 are made narrower and longer. We believe that these losses can be minimised if the connecting pipes 505,506 have a cross-sectional area which is twice that of the ports 510, 520, and if the pipes 505, 506 are kept reasonably short. The system needs to be tuned to avoid the internal cavity absorbing the resonance of the external cavity (and hence reducing the energy available.) In this case, the driver cavity resonance should be twice that of the port cavity resonance and hence the upper section is 'stiffer' than the lower section, keeping the system Q factor high to maximise energy available at the end of the connecting pipes 505, 506.

Figure 12:
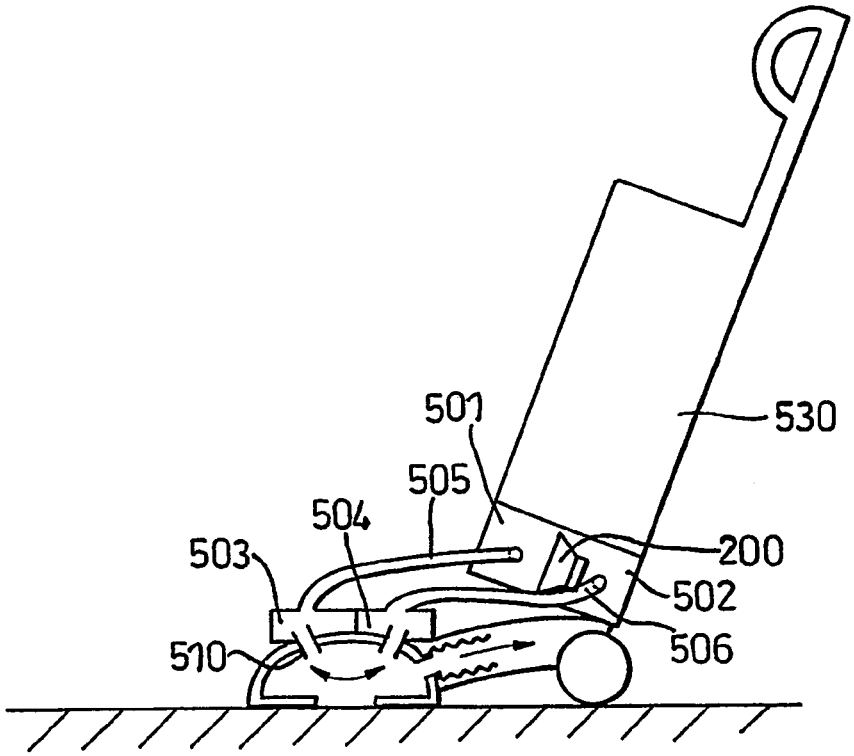
Figure 13:
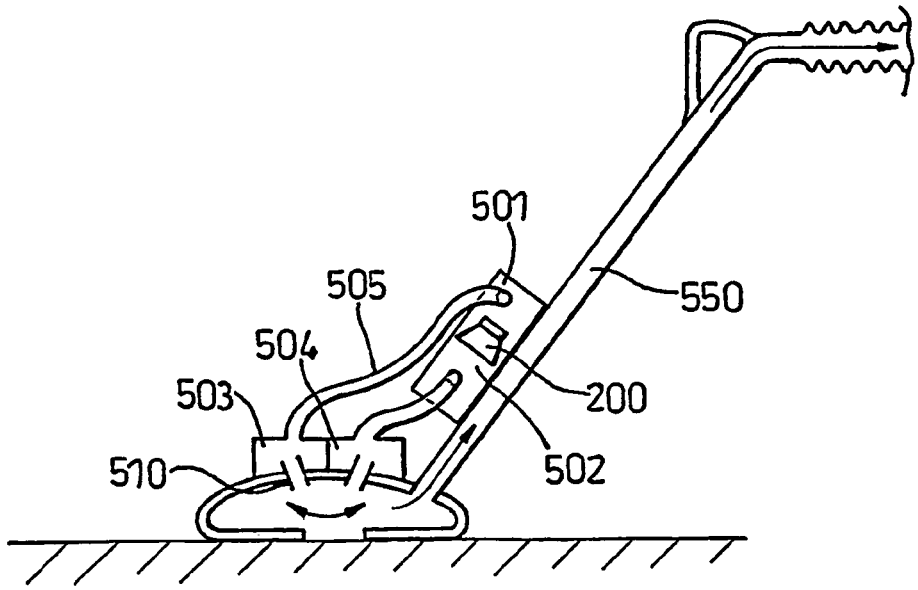

FIG. 12 shows one way in which this remote positioning of the drivers can be implemented in an upright type of vacuum cleaner, with the drivers 200 housed at the base of the upright part of the main body 530 of the vacuum cleaner. FIG. 13 shows one way in which the drivers 200 can be remotely housed on a cylinder type of vacuum cleaner, the drivers 200 and driver cavities being mounted to the wand 550 of the vacuum cleaner.

Figure 14:
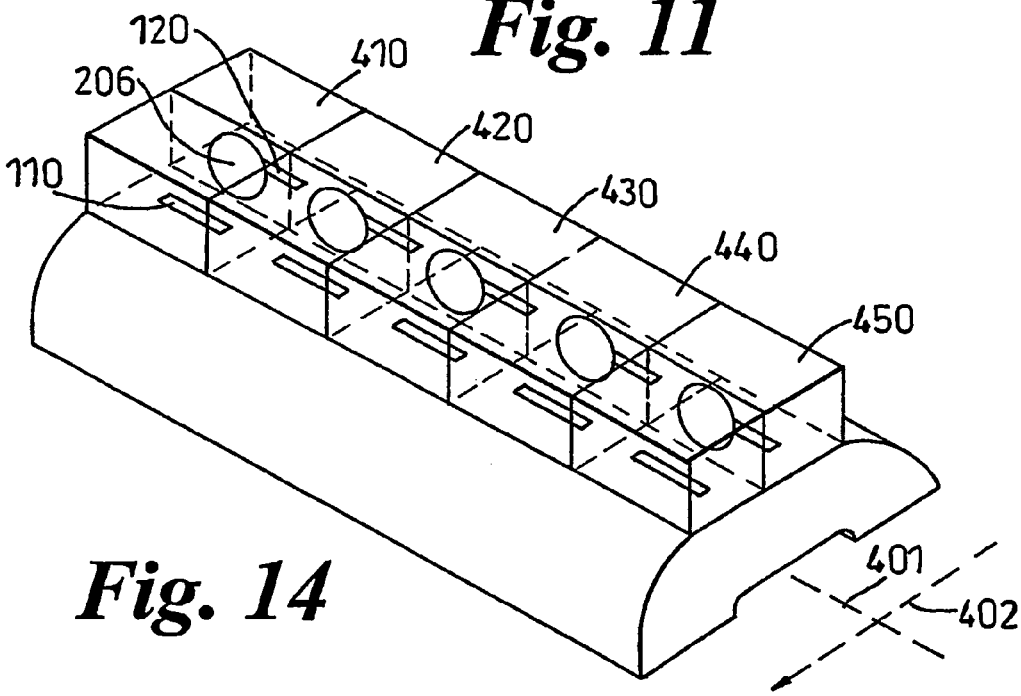
FIG. 14 shows a way of mounting a plurality of the agitation apparatus in a cleaning head.

While it is possible to provide a cleaning head with a single pair of cavities, it is preferred to employ an array of such devices in order that a good level of agitation is delivered across the entire width of the cleaning head. FIG. 14 shows a scheme with multiple sets of cavities. Each pair of cavities 410, 420, 430, 440, 450 are positioned front-to-back and aligned next to one another across the width of the cleaning head. For clarity, axis 401 indicates the longitudinal axis of the cleaning head and axis 402 represents front-to-back.

Figure 15:
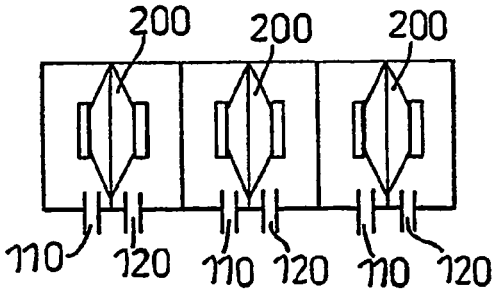
FIG. 15 shows another way of arranging a plurality of the agitation apparatus.

In an alternative scheme, each pair of cavities can be aligned with the longitudinal axis 401 of the cleaning head. FIG. 15 shows a cross-section along the longitudinal axis of a cleaning head in which the cavities are mounted in this way. The gaps between the ports should not degrade performance as there is significant air movement either side of the ports.

In a still further alternative scheme, each cavity can have multiple ports which connect the interior of the cavity with the suction housing. The driver should be appropriately matched to the volume of the cavity, the cross-sectional area of the ports and thus the amount of air which it is expected to move.

Figure 3:
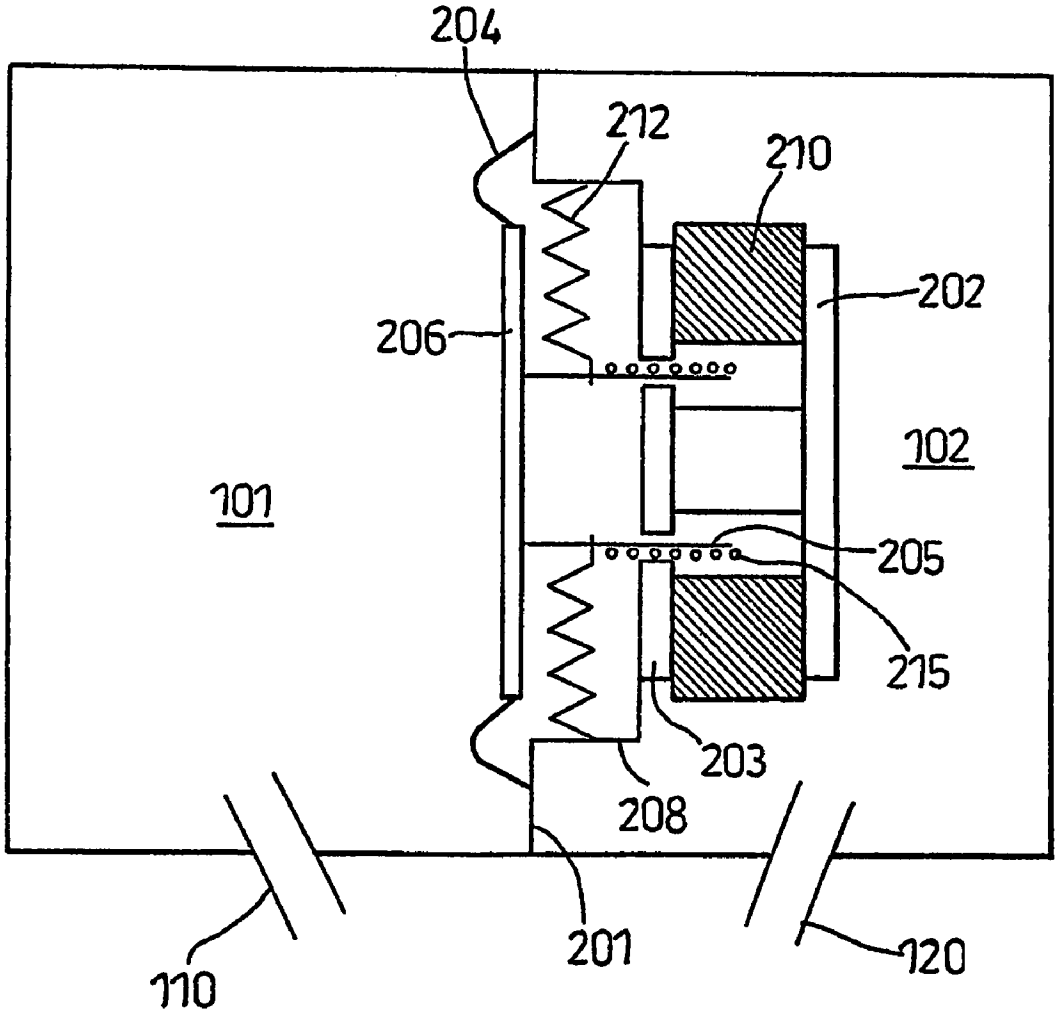
FIG. 3 shows the agitation apparatus in more detail.
Figure 16:
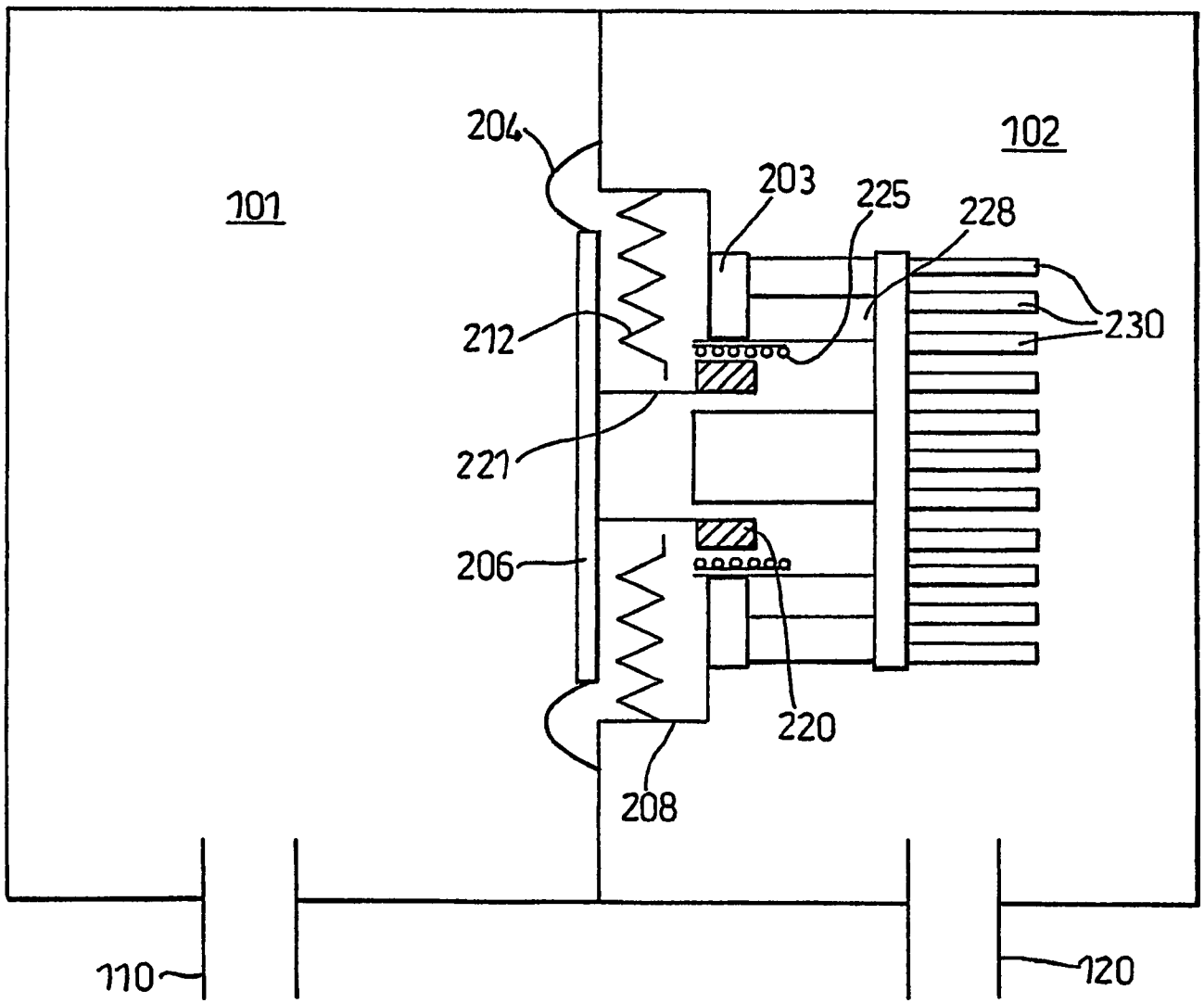
FIG. 16 shows an agitation apparatus which has an alternative form of generating means.

In the driver shown in FIGS. 2 and 3 the magnet 210 is stationary while the coil 215 is movable with the diaphragm. In an alternative form of driver, shown in FIG. 16, the driver has a fixed coil 225 and a movable magnet 220. Air movement through the ports 110, 120 can be used to cool the driver. Magnet 220 is in the form of a ring magnet which fits around a magnet former 221. A cavity 228 in the cup 203 at the rear of the driver houses a heat conducting fluid or gel and a heatsink is mounted on the rear of the pole plate. This should allow good cooling when the driver is driven hard since the air entering the port naturally passes the heatsink fins 230. This design may be preferable to a moving coil device in which the motion of the driver cools the coil by a bleed through the suspension. This also will allow a driver to be used with a sealed coil to prevent dust ingress.

In each of the embodiments described above, the driver has been a loudspeaker type of assembly driven by an ac source. However, the diaphragm can be moved in other ways, such as by a motor-driven piston. The frequency at which the diaphragm is moved can be in the same range as for the loudspeaker embodiments, and the control of the frequency of the diaphragm can be controlled by control of the motor speed.

Figure 18:
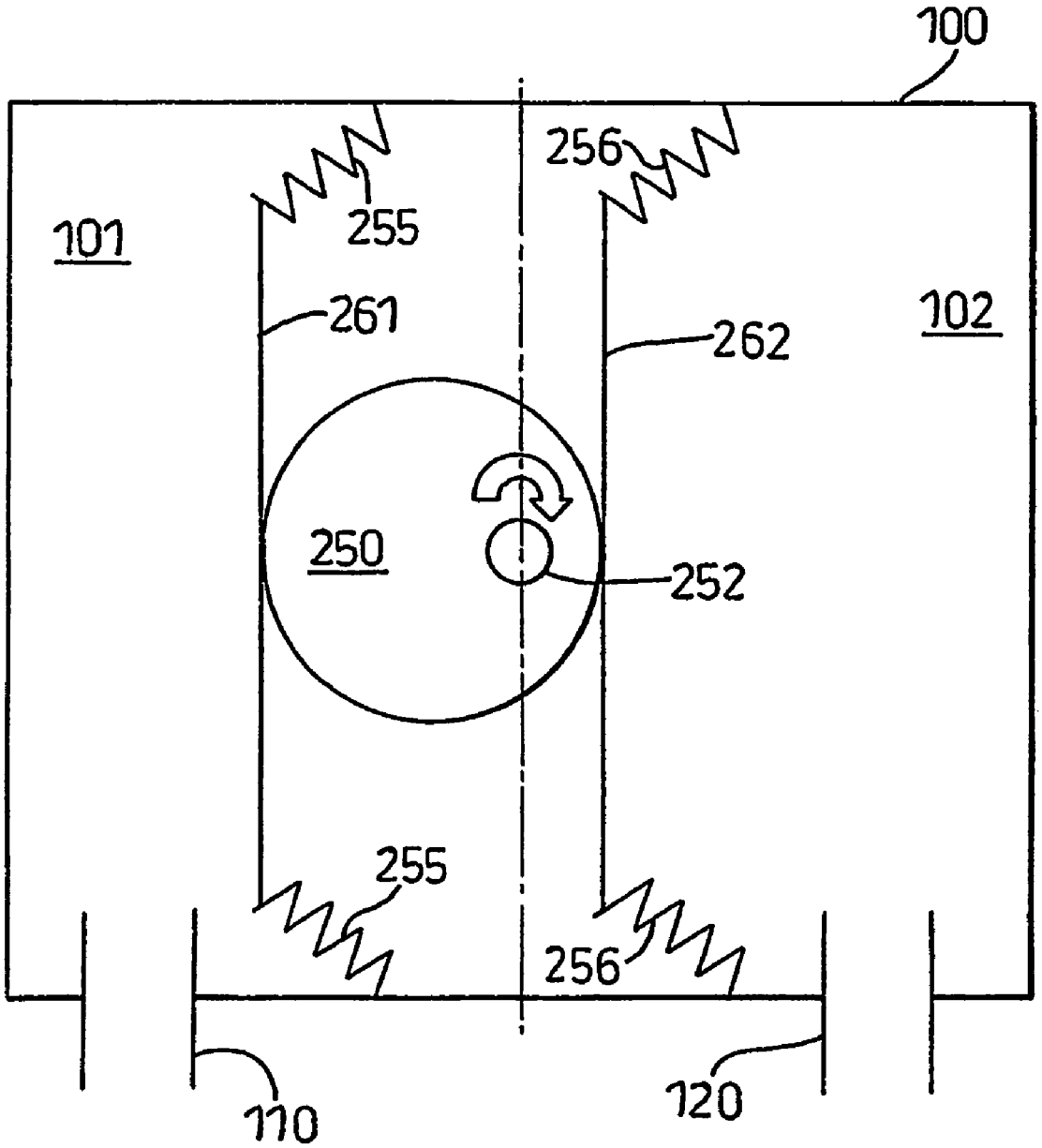
FIG. 18 shows an alternative form of the agitation apparatus.

In the scheme shown in FIG. 18 a housing 100 has two cavities 101, 102 with ports 110, 120, as before. Two diaphragms 261, 262 are positioned within the housing 100 and are connected to the wall of the housing 100 by a combined suspension and seal 255, 256. A cam 250 is mounted between the diaphragms 261, 262, the cam 250 being eccentrically mounted about a spindle 252. The spindle is driven by a motor via a direct or indirect (geared) coupling. The two diaphragms 261, 262 lie against the cam 250 at all times and thus the position of the diaphragms 261, 262 within their respective cavities 101, 102 is always controlled by the position of the cam 250. As cam 250 rotates, diaphragms 261, 262 move about a rest position. During one half of the cycle of the cam 250, diaphragm 261 moves towards the left, reducing the volume of cavity 101, while diaphragm 262 moves towards the left, increasing the volume of cavity 102. During the other half of the cycle of cam 250, diaphragm 261 moves towards the right, increasing the volume of cavity 101, while diaphragm 262 moves towards the right, decreasing the volume of cavity 102. Movement of the diaphragms 261, 262 generates a pressure wave in the same manner as the loudspeaker embodiments.

While it is convenient to power the driver via an electrical supply which is derived from a mains supply, it is also possible to power the driver by a turbine which is powered by air flow through the vacuum cleaner. The turbine can be positioned in the main airflow path through the machine—a so-called 'dirty air' turbine—or it can be positioned in a separate, clean air, airflow path into the machine. In FIG. 18 the spindle 252 which drives cam 250 can be coupled to a turbine via a geared connection. Knowing the normal airflow rates through a vacuum cleaner in which this is to be used, appropriate gearing can be provided between the turbine and the cam 250 so that the rate of rotation of the cam 250 is in the range required to agitate the floor surface.

The invention claimed is:

1. A cleaning head comprising a housing having a sole plate configured for traveling across a surface and an agitation apparatus comprising a wave generator configured for generating alternating pressure waves, a first fluid flow path with a first inlet/outlet port and a second fluid flow path with a second inlet/outlet port, the area adjacent first and second the inlet/outlet ports forming an agitation region, wherein the wave generator is arranged to generate a first alternating pressure wave along the first fluid flow path and a second alternating pressure wave along the second fluid flow path, the first and second pressure waves being substantially in an anti-phase relationship with one another and the first and second inlet/outlet ports are both generally directed downwardly towards the sole plate.

2. A cleaning head according to claim 1 wherein each flow path comprises a cavity.

3. A cleaning head according to claim 2 wherein the cavity is a resonating cavity.

4. A cleaning head according to claim 2 wherein the cavity in each flow path is of the same volume.

5. A cleaning head according to claim 2, 3 or 4 wherein the cavity is directly adjacent to the wave generator.

6. A cleaning head according to any one of claims 2 to 4 wherein each of the flow paths includes a cavity with a port extending directly from it.

7. A cleaning head according to claim 2, 3 or 4 wherein the cavity is located away from the wave generator and is joined to the wave generator by a duct.

8. A cleaning head according to claim 1, 2, 3 or 4 wherein the wave generator comprises a diaphragm, a first side of the diaphragm communicating with the first flow path and a second side of the diaphragm communicating with the second flow path whereby to generate the first and second alternating pressure waves.

9. A cleaning head according to claim 8 wherein the wave generator further comprises a driver for driving the diaphragm and wherein the driver is housed within one of the flow paths.

10. A cleaning head according to claim 8 wherein the wave generator further comprises two drivers for driving the diaphragm, and wherein the drivers are mounted on each side of the diaphragm, a first of the drivers being housed in the first flow path and a second of the drivers being housed within the second flow path.

11. A cleaning head according to claim 1, 2, 3 or 4 wherein the wave generator comprises two diaphragms, a first of the diaphragms communicating with the first flow path and the second of the diaphragms communicating with the second flow path, and a driver for driving the diaphragms which is positioned between the diaphragms.

12. A cleaning head according to claim 1, 2, 3 or 4 wherein the wave generator comprise a coil and a magnet, one of the coil or magnet being movable with respect to the other, the coil receiving an alternating signal for energizing the coil.

13. A cleaning head according to claim 12 wherein the coil receives a signal at the frequency of the mains supply.

14. A cleaning head according to claim 12 further comprising a signal source for generating an alternating signal for supplying to the coil.

15. A cleaning head according to claim 12 wherein the wave generator comprises a loudspeaker.

16. A cleaning head according to claim 1, 2, 3 or 4 wherein the wave generator is driven by airflow.

17. A cleaning head according to claim 16 further comprising a turbine for positioning in an airflow path to a vacuum cleaner and a coupling for coupling the output of the turbine to the wave generator.

18. A cleaning head according to claim 1, 2, 3 or 4 wherein the wave generator generates a pressure wave with a frequency in the range 0-200 Hz.

19. A cleaning head according to claim 18 wherein the frequency of operation of the wave generator is variable.

20. A cleaning head according to claim 19 wherein the frequency of the wave generator is manually adjustable by a user of the apparatus.

21. A cleaning head according to claim 19 further comprising a detector for detecting a type of floor surface to be cleaned by the cleaning head and wherein the frequency of operation of the wave generator is variable according to the detected type of floor surface.

22. A cleaning head according to claim 1 in the form of a cleaning head for a vacuum cleaner, wherein the housing is a suction housing having a suction outlet for connecting to a source of suction and the ports of the agitation apparatus are spaced apart along the housing.

23. A cleaning head according to claim 1 wherein the ports are inclined with respect to the sole plate of the cleaning head.

24. A cleaning head according to claim 1, comprising a plurality of the agitation apparatus.

25. A cleaning head according to claim 24 wherein the agitation apparatus are spaced along the longitudinal axis of the cleaning head.

26. A cleaning head according to claim 1 in the form of a tool for fitting to a wand.

* * * * *